United States Patent [19]

Barker et al.

[11] 4,335,025

[45] Jun. 15, 1982

[54] PROCESS FOR THE PREPARATION OF SYNTHETIC DETERGENT BARS, AND PRODUCTS PRODUCED THEREBY

[75] Inventors: Graham Barker, Fair Lawn; Leopold Safrin, East Orange; Martin J. Barabash, Montvale, all of N.J.

[73] Assignee: Witco Chemical Corporation, New York, N.Y.

[21] Appl. No.: 239,931

[22] Filed: Mar. 3, 1981

Related U.S. Application Data

[63] Continuation-in-part of Ser. No. 122,538, Feb. 19, 1980, abandoned.

[51] Int. Cl.[3] ..... C11D 1/04; C11D 1/12; C11D 11/04; C11D 17/00

[52] U.S. Cl. ..... 252/550; 252/174; 252/554; 252/555; 252/557; 252/558; 252/DIG. 16; 260/513 B

[58] Field of Search ..... 252/174, 550, 554, 555, 252/557, 558, DIG. 16; 260/513 B

[56] References Cited

U.S. PATENT DOCUMENTS

| | | | |
|---|---|---|---|
| 2,813,078 | 11/1957 | Vitalis | 252/161 |
| 2,894,912 | 7/1959 | Geitz | 252/121 |
| 3,206,408 | 9/1965 | Vitalis et al. | 252/161 |
| 3,231,606 | 1/1966 | Fessler | 260/513 |
| 3,625,910 | 12/1968 | Sweeney et al. | 252/554 |
| 3,640,882 | 2/1972 | Groves | 252/121 |
| 3,793,215 | 2/1974 | Smith | 252/117 |
| 3,862,965 | 1/1975 | Werner et al. | 252/555 |
| 3,901,832 | 8/1975 | Dugan et al. | 252/557 |
| 3,926,863 | 12/1975 | Perla et al. | 252/557 |
| 3,989,647 | 11/1976 | Prince | 252/535 |
| 4,007,125 | 2/1977 | Prince | 252/117 |
| 4,014,807 | 3/1977 | Werner et al. | 252/132 |
| 4,039,562 | 9/1977 | Bloch et al. | 260/401 |
| 4,092,259 | 5/1978 | Prince | 252/117 |
| 4,092,260 | 5/1978 | Prince | 252/117 |
| 4,096,082 | 6/1978 | Prince | 252/117 |
| 4,100,097 | 7/1978 | O'Roark | 252/145 |
| 4,110,239 | 8/1978 | Prince | 252/135 |
| 4,191,704 | 3/1980 | Mather et al. | 260/459 |

FOREIGN PATENT DOCUMENTS 1370284 10/1974 United Kingdom .

*Primary Examiner*—Dennis L. Albrecht
*Attorney, Agent, or Firm*—Albert L. Gazzola; Morton Friedman

[57] ABSTRACT

Synthetic detergent bars containing alkyl sulfosuccinate, surfactant, waxy extender and water, and process for preparing same.

13 Claims, No Drawings

PROCESS FOR THE PREPARATION OF SYNTHETIC DETERGENT BARS, AND PRODUCTS PRODUCED THEREBY

BACKGROUND OF THE INVENTION

This is a continuation-in-part of U.S. application Ser. No. 122,538 filed Feb. 19, 1980 and now abandoned.

It is well known that ever since the advent of synthetic detergents scientists have been trying to make so-called "syndet bars", viz, soap-like bars consisting entirely of synthetic detergent compositions or of a combination of synthetic detergent and conventional toilet soap compositions. Success has been marred by the fact that inclusion, for example, of significant quantities of synthetic detergents in toilet soap bars results in tackiness, poor latering, poor firmness, poor foaming, high solubility and any number other like difficulties, plus serious fabricating difficulties. As to manufacturing problems, the desideratum has been, and continues to be, the use of existing processing and manufacturing equipment, thus avoiding substantial costs inherent in modifying or replacing existing facilities.

It is well known, also, that synthetic detergents which are sufficiently inexpensive and have the requisite lathering and cleansing qualities are more soluble than fatty acid salts used in making conventional toilet soap bars and lack the plasticity of the latter. This solubility characteristic not only leads to excessive wear rates, but to significant slushing or sloughing when a syndet bar produced therefrom is left wet and/or placed on a wet surface; and poor plasticity means poor physical strength, as exhibited by poor processing characteristics and cracking and crumbling in use.

Other desiderata in attempts to duplicate or imitate conventional toilet bars are good wet and dry tactile properties ("feel"), absence of grittiness which occasions unsightly and annoying efflorescence, absence of scum- or curd-forming characteristics which are reflected as, inter alia, rings around a sink or bathtub at the water line.

Another very important aim of soap technologists is to avoid hydrolysis in aqueous solution at a pH of 10.2–10.4, which is characteristic of conventional soap. Such soap has several important shortcomings. Being alkaline, soap emulsifies the oily layer covering the natural horny layer (*stratum corneum*) of a person's skin and neutralizes a likewise natural acid mantle of the epidermis, which has, normally, an acid pH of approximately 5.5–6.5. Failure to readily regenerate the acid and oily part of the epidermis—particularly among older people—often results in dermato-logical symptoms, such as itching, chapping and cracking of the epidermis, especially in cold weather. Of course, always to be considered is that significant segment of the population which is allergic to or cannot tolerate conventional soaps in view of a number of reactions (sensitivities) resulting from the use thereof.

Modern soap technologists have tried constantly to ameliorate these shortcomings by deactivating some of the emulsifying properties of conventional soaps by incorporating therein fatty and oily ingredients. Stearic acid, lanolin, mineral oil and other so-called "superfatting agents" have been used to minimize the defatting and denaturing action of conventional soap. Also, cosmetic ingredients, e.g., cold creams, so-called moisturizers, various emulsions of lipids, hydrocarbons, petrolatum and hydroscopic agents, such as glycerine, sorbitol, and the like, have been added to the toilet soap base. Unfortunately, cleaning and lathering properties suffered upon the addition of these agents (additives). Furthermore, certain of these additives are conducive to the formation, in hard water, of calcium and magnesium soaps which inhibit lathering and give rise to the aforementioned scum.

From the above, it is apparent that there is real need for a syndet bar made of less expensive detergents which processes, lathers, foams and wears well, which exhibits minimized slushing and curd-forming properties, which possesses good plasticity and tactile characteristics, and which has a pH approximating that of a person's skin. The invention described infra is directed toward said need.

PRIOR ART

A search of the soap art in the U.S. Patent and Trademark Office has uncovered the following domestic and foreign patents which, as understood, manifest varying degrees of relevancy:

U.S. Pat. No. 2,894,912—a detergent bar consisting of an alkali metal salt of esters of isethionic acid; mixed aliphatic acids; a so-called suds-boosting detergent salt, e.g., alkyl aryl sulfonates; water; a higher fatty acid soap; and a higher fatty acid.

U.S. Pat. No. 3,231,606—a detergent bar prepared by reacting an ethylene homopolymer with a bisulfite, e.g., sodium bisulfite, in the presence of an alkaline agent, a polar organic solvent, and, advantageously, according to the patentee, a synthetic detergent or organic surface active agent. Reaction is induced by dispersing a gas containing molecular oxygen, such as air, through the reaction mixture.

U.S. Pat. No. 3,625,910—Non-soap detergent toilet bars are prepared from a complex mixture of hydrogenated olefin sulfonates (long chain) and water.

U.S. Pat. No. 3,640,882—a soap bar consisting of a fatty acid salt and a lesser amount of a lime soap curd dispersant which is a sulfosuccinate half ester prepared from ethoxylated alcohols.

U.S. Pat. No. 3,793,215—a detergent bar (according to the patent) comprising a major amount of soap and a minor amount of a fatty ester amide of sulfosuccinate.

U.S. Pat. No. 3,926,863—a process for preparing detergent bars comprising reacting a butenedioic acid with a high molecular weight alcohol (e.g., lauryl alcohol) to form the correspond-in monoalkyl ester of butenedioic acid, such as lauryl maleate, then reacting the ester with a sulfite (e.g., sodium bisulfite) to produce the monoalkylsulfosuccinate. The latter reaction is made to take place in the presence of a plasticizer, such as glyceryl monostearate or—according to the patent-paraffin wax; also, from 15 to 20% water is present.

U.S. Pat. No. 3,989,647—a synthetic toilet bar containing, as essential ingredients, (A) an alkali metal, magnesium or ammonium salt of a long-chain alkane sulfonate, (B) a superfatting agent, such as a coconut oil fatty acid, (C) a binder modifier, such as an alkali metal salt of a long-chain alkylsulfosuccinate, and (D) water. The ingredients may be homogeneously blended, or first co-dissolved in a water-solvent system.

U.S. Pat No. 4,007,125—the detergent bar of '912, supra, containing, in addition, a so-called anti-mushing agent, viz, sodium alkanesulfonate.

U.S. Pat. No. 4,039,526—a process for preparing salts of monoesters of sulfosuccinic acid by reacting a butenedioic acid half ester with crystalline sulfite of an alkali metal or alkaline earth metal, the only water present being that provided by the crystalline sulfite.

U.S. Pat. Nos. 4,092,259, 4,092,260, 4,096,082 and 4,110,239 all appear to contain the same disclosure as '647, supra. It would be expected since they are patents which issued out of divisional applications based on Application Ser. No. 419,558 out of which '647 emanated.

U.S. Pat. No. 4,100,097—a synthetic detergent bar which consists of coconut-oil fatty acid ester of sodium isethionate and/or sodium lauryl sulfoacetate, paraffin, powdered starch, dextrin, coconut-oil fatty acid and water.

U.S. Pat. No. 3,862,965—a detergent bar is formed from, for example, a monoesterified sulfoalkanedioic acid (e.g., $C_{12}$ monoester), a water-soluble salt of an olefin sulfonate having 10 to 18 carbon atoms, superfatting agents, water, and, optionally, anyone of an anionic, non-ionic and amphoteric surface active agent. The bar is prepared by kneading a mixture of the just-mentioned components at elevated temperatures, homogenizing the resulting blend on rolls, and then extruding in a strand which is subsequently cut and pressed into cakes of the desired shape.

British Pat. No. 1,370,284—a detergent bar is made of a hydrogenated olefin sulfonate or a mixture of alkane sulfonate with olefin sulfonate (all of which are long chain alkyls or olefins) to which is added up to 50% of a quaternary nitrogen compound, such as cetyl trimethyl ammonium bromide, octyl pyridinium chloride, or other like quaternary nitrogen compounds which are compatible with the sulfonate components. Conventional additives may be added, such as superfatting agents, lather modifiers, and the like.

U.S. Pat. No. 4,191,704—alkyl sulfates are prepared with a high concentration by mixing together an alkyl sulfuric acid and ammonium or an amine in the presence of sufficient water to maintain the product in the G phase (neat phase) above the minimum concentration at which gel formation is encountered.

U.S. Pat. No. 3,901,832—A process for the production of detergent cakes containing a monoalkysulfosuccinate and a plasticizer in which a monoaklyl ester of a butenedioic acid is reacted with a sulfite in the presence of a plasticizer in the liquid state and the article formed thereby. A typical plasticizer is glyceryl monostearate.

U.S. Pat. Nos. 2,813,078, 3,206,408 and 4,014,807 further indicate the state of the art.

The above-noted art is readily distinguishable from the present invention hereinafter described.

THE INVENTION

According to the present invention, syndet bars are produced which exhibit low wear rates, excellent lathering, good tactile properties, excellent cleaning characteristics and, in addition, manifest good processing characteristics. Also, the bars have a pH in the range from about 5.5 to about 7.2 and thus do not interfere with the normal pH of skin.

Surprisingly, the syndet bars of the present invention can be prepared in a very straightforward manner. For example, the heretofore cumbersome and costly step of drying a finished mass of syndet composition—in order to avoid undesirably high water concentrations—has been obviated. Pursuant to the process of the instant discovery, the resultant syndet soap mass contains relatively minor amounts of water, thus permitting direct utilization of the mass (syndet) in the processing of syndet bars without the need for extensive drying, and resulting in an overall short processing time.

In accordance with the present discovery, alkali metal salts of $C_8$–$C_{16}$ alkyl sulfosuccinates are prepared in situ, at elevated temperatures, in the presence of (i) a water-soluble anionic surfactant selected from the alkali metal salts of $C_{12}$–$C_{14}$ alkane sulfonate, $C_{12}$–$C_{14}$ alkaryl sulfonate, $C_{14}$–$C_{16}$ olefin sulfonate, $C_{10}$–$C_{16}$ acyl isethionate $C_{10}$–$C_{16}$ alkyl sulfoacetate, $C_{12}$–$C_{16}$ alkyl sulfate, and mixtures thereof; (ii) a waxy extender, such as a $C_{12}$–$C_{22}$ fatty acid or alcohol (preferably saturated), a hydrocarbon wax (e.g., a paraffin), a fatty acid ester of a polyhydric alcohol, or mixtures thereof; and (iii) water.

The $C_8$–$C_{16}$ alkyl sulfosuccinates are prepared in situ by reacting a corresponding $C_8$–$C_{16}$ alkyl mono-ester of butenedioic acid with an alkali metal sulfite in an aqueous dispersion of the surfactant in molten waxy extender. The reactant alkali metal sulfite is present, preferably, in about a stoichiometric amount relative to the butenedioic acid ester reactant, or in an excess not exceeding about 2.0 percent by weight, in order to avoid any significant excess of butenedioic acid or alkali metal sulfite in the reaction mass. In other words, "about a stoichiometric amount", as used herein, includes up to 2.0 percent by weight excess.

Sulfonation of the butenedioic acid ester, according to the present invention, is achieved in one of two ways: (i) the butenedioic acid ester is blended with the aqueous surfactant/extender dispersion and subsequently the alkali metal sulfite reactant slurried therewith at a controlled rate, or (ii) the alkali metal sulfite is slurried with the aqueous surfactant/extender dispersion and molten butenedioic acid ester reactant subsequently added thereto—also at a controlled rate. Control is required in view of the exothermic nature of the reaction, the rate being that required to avoid temperatures above about 85° C. A temperature of about 80° C.,±5° C., is maintained during a so-called digestion period, usually about 30 to 90 minutes, after completion of the controlled addition of the alkali metal sulfite or butenedioic acid ester.

The aqueous surfactant is dispersed in the pre-melted extenders (which melt at different temperatures, usually between 60° C. and 85° C.) with moderate agitation and while maintaining the just-noted temperatures. In short, the reaction mass is kept fluid throughout—also known as keeping it in the neat phase, as will be seen hereinafter.

If the alkali metal sulfite is added to a surfactant/extender/butenedioic acid ester melt, a controlled rate of blending generally involves slow addition of the alkali metal sulfite, such as sodium sulfite, over a period of about 25–35 minutes with stirring; if the butenedioic acid ester is added to a surfactant/extender/sulfite melt, a somewhat faster rate of addition may be employed, preferably over a period of about 10 to 20 minutes, while stirring.

Critical is maintenance of the water concentration in the reaction mass between about 5 to about 12 percent, preferably about 7 to about 10 percent, by weight, based upon the total weight of the reaction mass. The fact that such low concentrations of water may be employed is, indeed, very surprising, it will be seen. As indicated hereinbefore, the art has been plagued with the costly step of drying a finished mass of syndet soap composition, in order to avoid undesirably high water concentrations and to permit utilization of the mass in the processing of syndet bars. Of course, the drying step (usually extensive) substantially augments, inter alia, total processing time.

Critical to the present invention, also, are the surfactant and waxy extender components, and their concentrations, when coupled with the heretofore-mentioned butenedioic acid ester/alkali metal sulfite stoichiometry. Process-ability, for example, of the syndet composition prepared as above taught is very much dependent upon a careful correlation of the concentrations of all these components in order to maintain a desirable fluidity (i.e., a neat phase) throughout reaction at elevated temperatures. The art has had to contend not only with the cumbersome drying bane, but experience has been that the reaction mass viscosity readily increased (i.e., fluidity yielded to a jelly-like mass).

Such viscous masses hampered not only processing but they dictated the need for the use of excess alkali metal sulfite (up to about 10%) and/or the use of NaCl which is contraindicated in the manufacture of syndet bars (as well as soap), since it very often causes cracking of the bars during use.

It is believed that the morphology of the reaction mass, which apparently and quite surprisingly results from careful correlation of the concentrations of the aforementioned components under the reaction conditions discussed herein, accounts for the desirable fluidity (neat phase) achieved, thus enhancing processing time and the nature of the product. Deviation from the aforenoted concentrations and conditions, such as by the use of higher levels of water, results in transformation of the reaction mass to a so-called middle phase (viscous jelly-like phase) instead of the manageable neat phase, also known as the G phase or lamellar phase.

Adjuvant components may be present in the compositions of the present invention. For example, hydrogen peroxide may be added to the extent needed to remove unreacted alkali metal sulfite. Other additives may be incorporated in minor quantities for their known purposes. For instance, metallic stearates, such as zinc stearate, and hydrogenated vegetable glyceride phosphates, can be added to improve processing properties, addition being made in the initial molten reaction medium or following reaction. Another helpful adjuvant is a high molecular weight polyethylene glycol which aids the lathering properties of the syndet bar. It is best incorporated when reaction is complete.

Other known extenders, such as modified food starches, urea, clays, talc, and the like, can be likewise introduced, if desired, when reaction is complete. These are generally optional ingredients when lower concentrations of the aforementioned waxy extenders are used in the reaction medium.

Fortunately, the above adjuvants, when present in minor quantities, as contemplated herein, do not affect the fluidity of the reaction mass.

Of course, there may be added other conventional additives in minor quantities, such as whiteners, perfumes, stabilizers, antioxidants, and the like, without straying beyond the perimeter of the instant invention.

It is important, however, that, based upon the total weight of the reaction mass, i.e., as opposed to the finished mass, the following essential components be present within the following concentration ranges (the combined weight of the sulfite and butenedioic acid ester reactants representing essentially the total weight of their reaction product, i.e., the alkyl sulfosuccinate in the finished mass):

| COMPONENT | % by weight | |
|---|---|---|
| | Broad range | Preferred range |
| sulfite | 6–16 | 8–14 |
| butenedioic acid ester | 18–35 | 20–33 |
| surfactant | 4–20 | 7–12 |
| waxy extender | 13–45 | 23–40 |
| water | 5–12 | 7–10 |
| other extender | 0–20 | 5–15 |

Obviously, as indicated above, in order to avoid a substantial excess of either alkali metal sulfite or butenedioic acid ester reactant, preferably stoichiometric quantities of these reactants are employed, resulting in an alkyl sulfosuccinate concentration in the finished mass of about 24 to about 51 percent, preferably about 28 to about 47 percent.

Several methods may be used to form syndet bars from the reaction mass produced as shown supra. If desired, the reaction mass, while still fluid, is poured onto a chill-roll and resulting flakes then processed in a soap plodder which yields an extrusion mass from which a syndet bar is stamped. Alternatively, the fluid reaction mass is cast on trays, allowed to solidify, and then milled several times on a roller-mill. Resultant milled flakes are subsequently put through a soap plodder and the extruder material pressed into bars.

The present invention will best be understood from the following examples which are intended to be illustrative of preferred embodiments of the invention, but by no means limiting:

EXAMPLE I

Fifteen (15) parts of hydrogenated tallow fatty acid (HFTA, stearic acid) and 10 parts of paraffin (Aristowax 143) are melted together at 70° C.–75° C. and while maintaining that temperature 8.0 parts of sodium $C_{12}$–$C_{14}$ alkane sulfonate (NAS), 5.0 parts zinc stearate, and 10 parts of water are dispersed in the waxy melt, with moderate agitation.

Lauryl maleate (31.5 parts) is melted with the waxy melt and $Na_2SO_3$ (13.5 parts) is added slowly to the reaction mass over a period of 30 minutes, with stirring, while allowing the temperature-due to reaction-to rise to 80°–85° C. Upon completion of the sulfite addition, the reaction mass is maintained at 80° C.±5° C. for about 45 minutes. At the end of this period, 5.0 parts polyethylene glycol 14,000 (PEG 14,000 flake) is blended in the reaction mass.

Next, the resulting reaction mass is cast on trays, milled two (2) times on a 3-roll mill. The milled flakes thus produced are then put through a soap plodder and the thus extruded finished mass pressed into syndet bars.

Physical properties of the fluid reaction mass, as well as flakes and syndet bars formed therefrom, will be discussed hereinafter.

EXAMPLE II

Example I is repeated in every essential respect with the exception that zinc stearate is omitted, but 2 parts of a hydrogenated vegetable glyceride phosphate (Emphos 2785) is present in the original waxy blend. After casting on trays, the solids are milled 3 times.

EXAMPLE III

Example II is repeated in every essential respect with the exception that zinc stearate (3 parts) is added after the reaction of the lauryl maleate and $Na_2SO_3$ is completed.

EXAMPLE IV

Example II is repeated in every essential respect with the exception that the HTFA and paraffin components are replaced by 25 parts of cetyl alcohol, and the hydrogenated vegetable glyceride phosphate component is omitted.

EXAMPLE V

Ten (10) parts of paraffin and 5 parts of cetyl alcohol are melted and blended at 70° C.–75° C. and while maintaining that temperature 8 parts of sodium $C_{14}$–$C_{16}$ olefin sulfonate and 12 parts of sodium $C_{12}$–$C_{14}$ alkane sulfonate, as well as 12 parts $H_2O$, are dispersed in the waxy melt, with moderate agitation.

Sodium sulfite (8 parts) is slurried in the waxy melt containing the dispersed sulfonates and $H_2O$, and then melted lauryl maleate (19 parts) is added over a 15-minute period, with stirring, and temperature is allowed to rise due to the exothermic reaction to 80° C.±5° C. by controlled addition of the maleate. Subsequently, the reaction mass is allowed to digest at 80° C.±5° C. for about 45 minutes. After the reaction is complete, 5 parts of polyethylene glycol 14,000 and 20 parts of modified corn starch are admixed with the reaction mass. Processing as in Ex. II, above.

EXAMPLE VI

Example V is repeated in every essential respect with the exception that the olefin sulfonate, cetyl alcohol, and polyethylene glycol are omitted. HTFA (25 parts) is added, and the concentrations of the following components are changed to: lauryl maleate (21 parts), sodium sulfite (9 parts), alkane sulfonate (8 parts), paraffin (15 parts), and modified corn starch (10 parts).

EXAMPLE VII

Example V is repeated in every essential respect with the exception that the alkane sulfonate and cetyl alcohol components are omitted, 25 parts of HTFA is used, and the concentrations of the following components are changed to: lauryl maleate (28 parts), sodium sulfite (12 parts), olefin sulfonate (10 parts), paraffin (15 parts), and modified corn starch (10 parts).

EXAMPLE VIII

Example V is repeated in very essential respect with the exception that the alkane sulfonate and polyethylene glycol components are omitted and 5 parts urea is added following completion of the reaction. In addition, the concentrations of the following components are changed as follows: lauryl maleate (32 parts), sodium sulfite (10 parts), olefin sulfonate (7 parts), cetyl alcohol (15 parts), and $H_2O$ (10 parts).

Not only do the syndet compositions produced as taught above exhibit good to excellent processing characteristics, including milling and stamping, but syndet bars prepared therefrom show predominantly excellent flash foam, lather and tactile properties. Sloughing or wear rate percentage ranges from 2.0 to 12.1, contrary to expectations. The reaction mass appearance (final) is fluid, as would be desired.

The foregoing low wear rates are observed when comparing conventional syndet bars consisting entirely of synthetic detergent compositions or combinations of synthetic detergents and conventional toilet soap compositions. Wear rates are determined by immersing a 2½ oz. bar in water (at ambient temperature) so that 50% of the bar is immersed in the water. After 24 hours, soft water-soluble mass is wiped away and loss in weight is recorded.

The following examples in table form, in which parts by weight are given, further illustrate the present invention:

EXAMPLES IX–XIV

TABLE

| Component | Example No. IX | X | XI | XII | XIII | XIV |
|---|---|---|---|---|---|---|
| Myristyl maleate | — | — | 31.5 | 23 | 21 | 23 |
| Palmityl maleate | 19 | 23 | — | — | — | — |
| Sodium sulfite | 8 | 10 | 13.5 | 10 | 9 | 10 |
| Sodium $C_{12}$–$C_{14}$ alkyl benzene sulfonate | 15 | — | 17 | — | 10 | — |
| Sodium lauroyl isethionate | — | 11 | — | — | — | — |
| Sodium lauryl sulfate | — | — | — | 12 | — | — |
| Sodium lauryl sulfoacetate | — | — | — | — | — | 8 |
| Cetyl alcohol | — | 10 | 23 | 16 | 10 | — |
| HTFA | 25 | — | — | — | 26 | 4 |
| Glyceryl monostearate | — | 16 | — | 12 | 12 | — |
| Modified corn starch | 14 | 12 | — | 9 | 4 | 20 |
| Zinc stearate | 6 | — | 3 | 4 | — | 5 |
| Polyethylene glycol 14,0000 (PEG 14,000 Flake) | 3 | 6 | 2 | 6 | 2 | 5 |
| $H_2O$ | 10 | 12 | 9 | 8 | 6 | 5 |
| | 100 | 100 | 100 | 100 | 100 | 100 |

Examples X, XII, XIII, and XIV are prepared by using the method of Example I, supra, and the processing steps of Example II. The starch and PEG components are incorporated toward the end of the digestion period.

Examples IX and XI are prepared by the method of Example V, supra; processing to form syndet bars is carried out according to Example II, above. The starches, inorganic extenders, and PEG components are incorporated after the digestion period. Preferably, in all of the examples herein these additives are incorporated after the completion of the reaction to be fully blended in the fluid reaction mass.

As indicated heretofore, the process of the present discovery is straightforward and unexpectedly enables the reaction mass to retain its fluidity throughout the entire course of reaction. This is so for a number of reasons. Typically, the percentage of water remaining after the reaction and attendant digestion period ranges from 5 to about 10%, enabling direct utilization of the reaction mass in the processing of syndet bars without necessitating drying of the finished mass. In addition, the overall reaction time is relatively short. These advantages and others are apparent to the soap technologist.

Pursuant to statutory requirements, there are described above the invention and what are now considered its best embodiments. It should be understood, however, that the invention can be practiced otherwise than as specifically described above and still be within the scope of the appended claims.

What is claimed is:

1. A process for in situ preparation of synthetic detergent compositions suitable for direct utilization in the processing of syndet bars having improved soap-like properties which comprises blending, at elevated temperatures and at a controlled rate, about a stoichiometric amount of a $C_8$–$C_{16}$ alkyl mono-ester of butenedioic acid with an alkali metal sulfite in an aqueous dispersion of a water-soluble anionic surfactant in a molten waxy extender, the water concentration being between about 5 and about 12 percent, by weight, based upon the total weight of the reaction mass, said mass being kept fluid throughout the reaction and maintained at a temperature below about 85° C.; and, likewise based upon the total weight of the reaction mass, the surfactant being present in the concentration of about 4 to about 20 percent, and the waxy extender in the concentration of about 18 to about 45 percent, the anionic surfactant being selected from water-soluble alkali metal salts of $C_{12}$–$C_{14}$ alkaryl sulfonate, $C_{14}$–$C_{16}$ olefin sulfonate, $C_{10}$–$C_{16}$ acyl isethionate, $C_{10}$–$C_{16}$ alkyl sulfoacetate, $C_{12}$–$C_{16}$ alkyl sulfate, $C_{12}$–$C_{14}$ alkane sulfonate, and mixtures thereof; and recovering resulting mono-alkyl sulfocsuccinate-containing syndet composition.

2. The process of claim 1 wherein the waxy extender is selected from a $C_{12}$–$C_{22}$ fatty acid or alcohol, a hydrocarbon wax, and a fatty acid ester of a polyhydric alcohol, and mixtures thereof.

3. The process of claim 1 wherein the reactants are blended at the rate required to provide a temperature of about 80° C.±5° C. and the reaction mass maintained at this temperature during a digestion period of about 30 to 90 minutes.

4. The process of claim 1 wherein either of the reactants is first blended in the aqueous dispersion of the surfactant in molten waxy extender and the remaining reactant subsequently added at said controlled rate.

5. The process of claim 1 wherein the components in the reaction mass are present in the following concentrations, given in percent by weight, based upon the weight of the reaction mass:

| | |
|---|---|
| butenedioic acid ester | 18–35 |
| alkali metal sulfite | 6–16 |
| surfactant | 4–20 |
| waxy extender | 18–45 |
| water | 5–12 |
| other extender | 0–20 |

6. The process of claim 5 wherein the components in the reation mass are present in the following concentrations, in percent by weight, based upon the total weight of the reaction mass:

| | |
|---|---|
| butenedioic acid ester | 20–33 |
| alkali metal sulfite | 8–14 |
| surfactant | 7–12 |
| waxy extender | 23–40 |
| water | 7–10 |
| other extender | 5–15 |

7. The process of claim 5 wherein the finished mass, following dispersion, contains about 24 to about 51 percent by weight, based upon the total weight of the finished mass, of $C_8$–$C_{16}$ alkyl sulfosuccinate, and about 5 to about 10 percent water.

8. The process of claim 7 wherein the fluid finished mass is solidified by cooling and formed into flakes which are converted to syndet bars by conventional soap processing.

9. The process of claim 8 wherein the reactants are lauryl maleate and sodium sulfite.

10. The process of claim 9 wherein the surfactant is $C_{12}$–$C_{14}$ alkane sulfonate.

11. The process of claim 9 wherein the waxy extender is selected from hydrogenated tallow fatty acid, paraffin, and cetyl alcohol, and mixtures of these.

12. The process of claim 11 wherein the surfactant is $C_{14}$–$C_{16}\alpha$-olefin sulfonate.

13. The process of claim 12 wherein the waxy extender is cetyl alcohol.

* * * * *